US011430620B1

(12) United States Patent
Liu et al.

(10) Patent No.: US 11,430,620 B1
(45) Date of Patent: Aug. 30, 2022

(54) KEYBOARD DEVICE AND KEY STRUCTURE THEREOF

(71) Applicant: Primax Electronics Ltd., Taipei (TW)

(72) Inventors: Chun-Yuan Liu, Taipei (TW); Tsu-Yi Chen, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/389,074

(22) Filed: Jul. 29, 2021

(30) Foreign Application Priority Data

Jun. 22, 2021 (TW) ..... 110122796

(51) Int. Cl.
*H01H 13/12* (2006.01)
*H01H 13/7065* (2006.01)
*H01H 3/12* (2006.01)

(52) U.S. Cl.
CPC ..... *H01H 13/7065* (2013.01); *H01H 3/125* (2013.01); *H01H 2231/002* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 10,692,667 | B1 * | 6/2020 | Jhuang | H01H 13/14 |
| 2019/0287744 | A1 * | 9/2019 | Wu | H01H 13/807 |
| 2019/0378667 | A1 * | 12/2019 | Ling | H01H 3/125 |
| 2021/0005407 | A1 * | 1/2021 | Lin | H01H 3/125 |

* cited by examiner

*Primary Examiner* — Ahmed M Saeed
(74) *Attorney, Agent, or Firm* — Kirton McConkie; Evan R. Witt

(57) ABSTRACT

A keyboard device includes plural key structures. Each key structure includes a base plate, a keycap, a connecting member and at least one raised structure. The keycap is located over the base plate. The connecting member is arranged between the base plate and the keycap. The keycap is movable upwardly or downwardly relative to the base plate through the connecting member. The connecting member includes at least one first hook part. The raised structure is installed on the base plate. The first hook part is connected with the raised structure. The raised structure includes a top wall, a lateral wall and a perforation. The lateral wall is connected between the top wall and the base plate. The perforation is formed in the lateral wall. The first hook part is penetrated through the perforation and contacted with the top wall.

9 Claims, 6 Drawing Sheets

KEYBOARD DEVICE AND KEY STRUCTURE THEREOF

FIELD OF THE INVENTION

The present invention relates to an input device, and more particularly to a keyboard device and a key structure thereof.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, texts or symbols can be inputted into the computer system directly. As a consequence, most users and most manufacturers of input devices pay much attention to the development of keyboard devices.

Generally, a keyboard device comprises plural key structures. Each key structure comprises a keycap, a scissors-type connecting member, a membrane circuit board and a base plate. These components are stacked on each other sequentially. In case that the keyboard device is a luminous keyboard device, the keyboard device is equipped with a backlight module under the base plate.

Moreover, a membrane switch is installed on the membrane circuit board, and an elastic element is arranged between the keycap and the membrane circuit board. The scissors-type connecting member is connected between the keycap and the base plate. Moreover, the scissors-type connecting member comprises a first frame and a second frame. The second frame is pivotally coupled to the first frame. Consequently, the first frame and the second frame can be swung relative to each other. While the keycap of any key structure is pressed down and moved downwardly relative to the base plate, the first frame and the second frame of the scissors-type connecting member are switched from an open-scissors state to a stacked state. Moreover, as the keycap is moved downwardly to compress the elastic element, the corresponding membrane switch is pushed and triggered by the elastic element. Consequently, the keyboard device generates a corresponding key signal.

When the keycap of the key structure is no longer pressed, the keycap is moved upwardly relative to the base plate in response to an elastic force of the elastic element. Meanwhile, the first frame and the second frame are switched from the stacked state to the open-scissors state, and the keycap is returned to its original position.

For providing the sufficient structural strength of the overall keyboard device, a metallic material with higher strength is usually used as the material of the base plate. However, since the metallic material with the higher strength usually has a higher specific gravity, the overall weight of the keyboard device is largely increased. For effectively reducing the overall weight of the keyboard device, an aluminum plate is used as the base plate of the keyboard device by many manufacturers. However, after the aluminum plate is subjected to a bending process, the strength of the aluminum plate is usually insufficient. For example, the base plate is usually equipped with plural upwardly-bent hooks to be connected with the scissors-type connecting member. Since the upwardly-bent hooks have insufficient strength, the hooks are readily broken when the scissors-type connecting member is connected with the base plate through these hooks. For increasing the strength of the hooks, some keyboard manufactures produce the hooks on the aluminum base plate by an in-mold injection process. Although the strength of the hooks produced by the in-mold injection process is increased, the fabricating cost of using the in-mold injection process is largely increased.

Therefore, there is a need of providing an improved keyboard device in order to overcome the drawbacks of the conventional technologies.

SUMMARY OF THE INVENTION

An object of the present invention provides a keyboard device. In a key structure of the keyboard device, a raised structure with high pull-out resistance is installed on a base plate.

An object of the present invention provides a key structure. In the key structure, a raised structure with high pull-out resistance is installed on a base plate.

The other objects and advantages of the present invention will be understood from the disclosed technical features.

In accordance with an aspect of the present invention, a keyboard device is provided. The keyboard device includes plural key structures. Each of the plural key structures includes a base plate, a keycap, a connecting member and at least one raised structure. The keycap is located over the base plate. The connecting member is arranged between the base plate and the keycap. The keycap is movable upwardly or downwardly relative to the base plate through the connecting member. The connecting member includes at least one first hook part. The at least one raised structure is installed on the base plate. The at least one first hook part of the connecting member is connected with the at least one raised structure. Each of the at least one raised structure includes a top wall, a lateral wall and a perforation. The lateral wall is connected between the top wall and the base plate. The perforation is formed in the lateral wall. The at least one first hook part of the connecting member is penetrated through the corresponding perforation and contacted with the corresponding top wall.

In an embodiment, the lateral wall of each of the at least one raised structure includes a first wall part, a second wall part, a third wall part and a fourth wall part. The first wall part and the second wall part are opposed to each other. The third wall part and the fourth wall part are opposed to each other. The first wall part and the second wall part are arranged between the third wall part and the fourth wall part. The perforation is arranged between the second wall part and the third wall part.

In an embodiment, the base plate includes at least one opening, and the at least one opening is in communication with the perforation of the at least one raised structure.

In an embodiment, the at least one raised structure is integrally formed with the base plate.

In an embodiment, the connecting member further includes a first frame, a second frame and at least one second hook part. The first frame and the second frame are pivotally coupled to each other. The at least one first hook part is connected with the first frame. The at least one second hook part is connected with the second frame. The at least one first hook part connected with the first frame is penetrated through the perforation of the at least one raised structure and contacted with the top wall. Consequently, the first frame is installed on the base plate.

In an embodiment, each of the plural key structures further includes at least one coupling structure, and the at least one coupling structure is installed on the base plate. The at least one coupling structure and the at least one raised structure are respectively installed on two opposite sides of the base plate. The at least one second hook part of the connecting member is connected with the at least one coupling structure. Each of the at least one coupling structure includes a coupling hole. The at least one second hook part connected with the second frame is penetrated through the coupling hole of the at least one coupling structure. Consequently, the second frame is installed on the base plate.

In an embodiment, each of the plural key structures further includes a membrane circuit board, and the membrane circuit board is arranged between the base plate and the keycap. The membrane circuit board includes at least one first hollow portion and at least one second hollow portion. The at least one raised structure is penetrated through the at least one first hollow portion and connected with the at least one first hook part on the first frame. The at least one coupling structure is penetrated through the at least one second hollow portion and connected with the at least one second hook part on the second frame.

In an embodiment, the at least one coupling structure is integrally formed with the base plate.

In an embodiment, the connecting member is a scissors-type connecting member.

In accordance with another aspect of the present invention, a key structure is provided. The key structure includes a base plate, a keycap, a connecting member and at least one raised structure. The keycap is located over the base plate. The connecting member is arranged between the base plate and the keycap. The keycap is movable upwardly or downwardly relative to the base plate through the connecting member. The connecting member includes at least one first hook part. The at least one raised structure is installed on the base plate. The at least one first hook part of the connecting member is connected with the at least one raised structure. Each of the at least one raised structure includes a top wall, a lateral wall and a perforation. The lateral wall is connected between the top wall and the base plate. The perforation is formed in the lateral wall. The at least one first hook part of the connecting member is penetrated through the corresponding perforation and contacted with the corresponding top wall.

From the above descriptions, the present invention provides the keyboard device. The key structure of the keyboard device comprises at least one raised structure, which is integrally formed with the base plate. In accordance with a feature of the present invention, the raised structure is a non-open structure with high pull-out resistance. Consequently, after the connecting member is connected with the raised structure and installed on the base plate, the frequent upward/downward movement of the connecting member will not damage and break the raised structure. In this way, the structural strength of the keyboard device is enhanced. Since the raised structure is directly formed on the base plate by a stamping process, the fabricating process is simplified, and the fabricating cost is reduced. In addition, the raised structure formed by the stamping process has a small thickness. Consequently, the outer thickness of the keyboard device is further reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
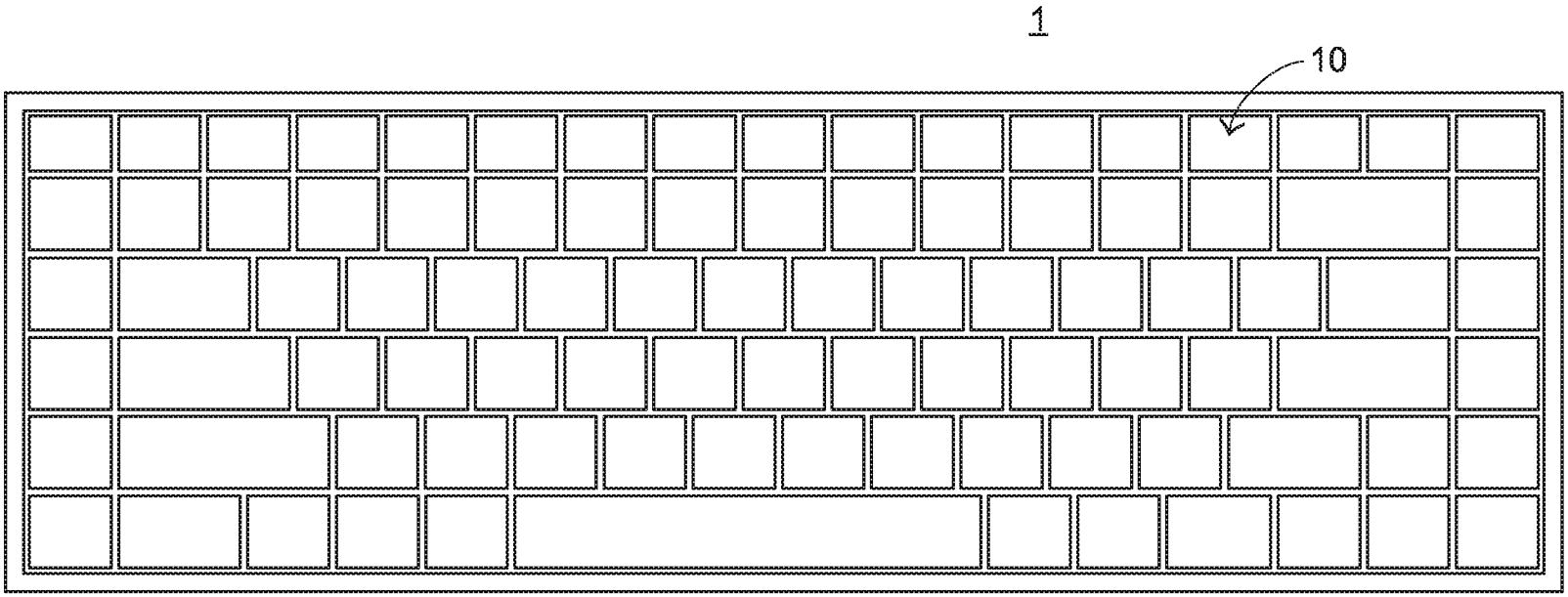
FIG. 1 is a schematic top view illustrating the outer appearance of a keyboard device according to an embodiment of the present invention.
Figure 2:
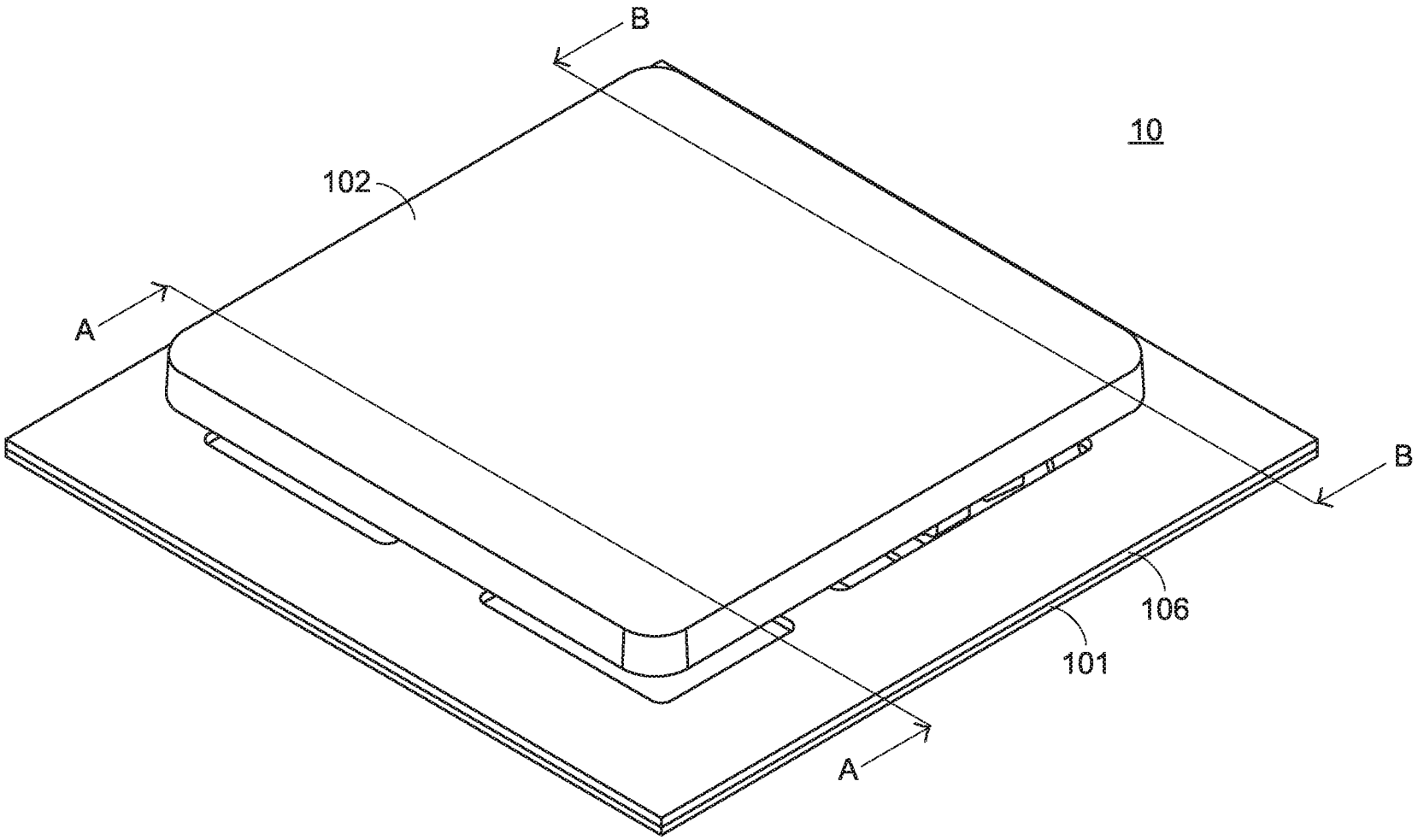
FIG. 2 is a schematic perspective view illustrating a portion of a key structure of the keyboard device as shown in FIG. 1.
Figure 3:
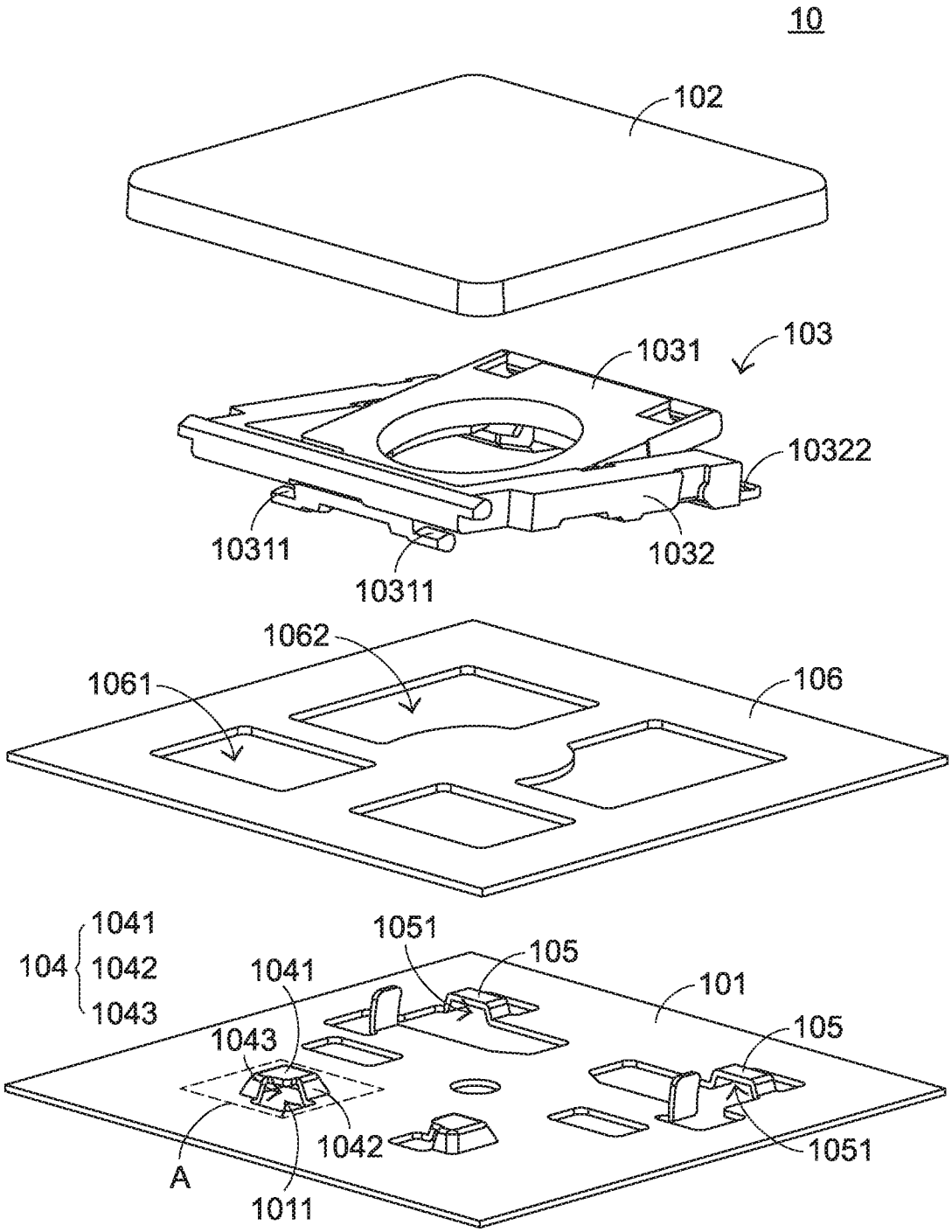
FIG. 3 is a schematic exploded view illustrating the key structure as shown in FIG. 2.
Figure 4:
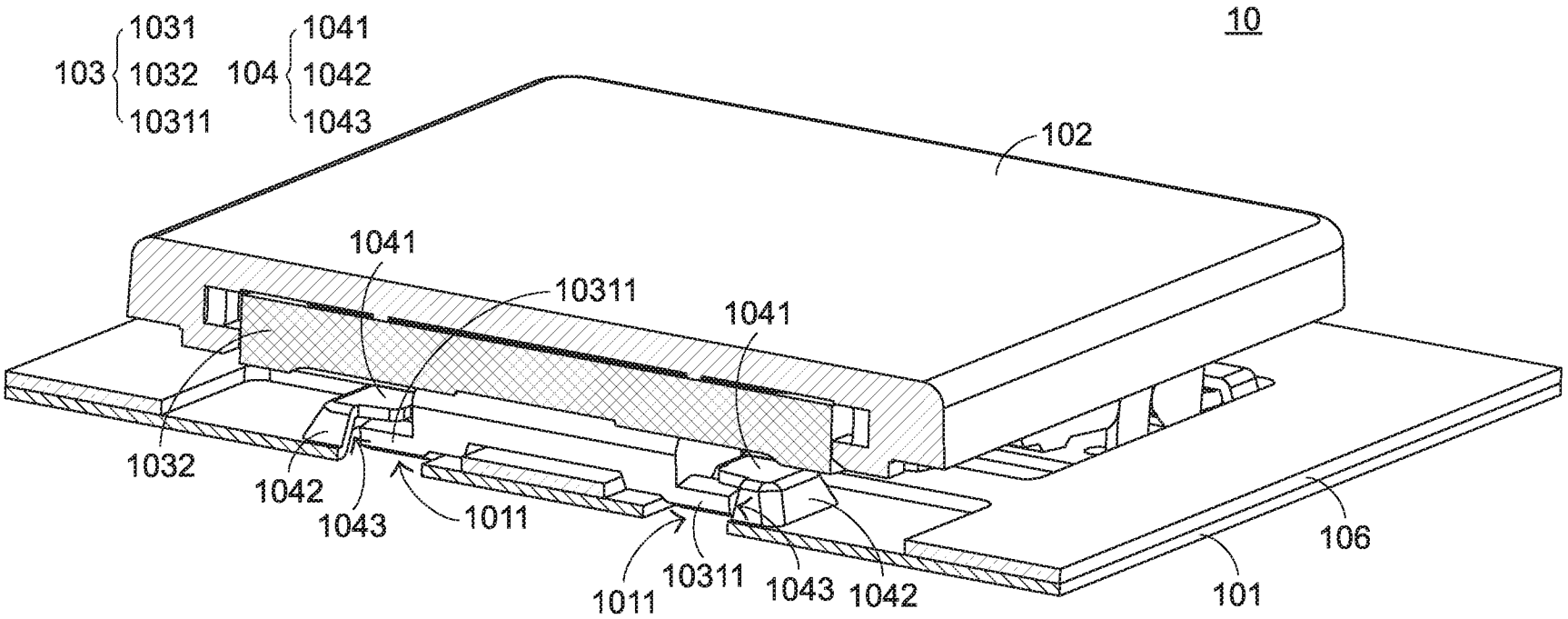
FIG. 4 is a schematic cutaway view illustrating the key structure as shown in FIG. 2 and taken along the line AA.
Figure 5:
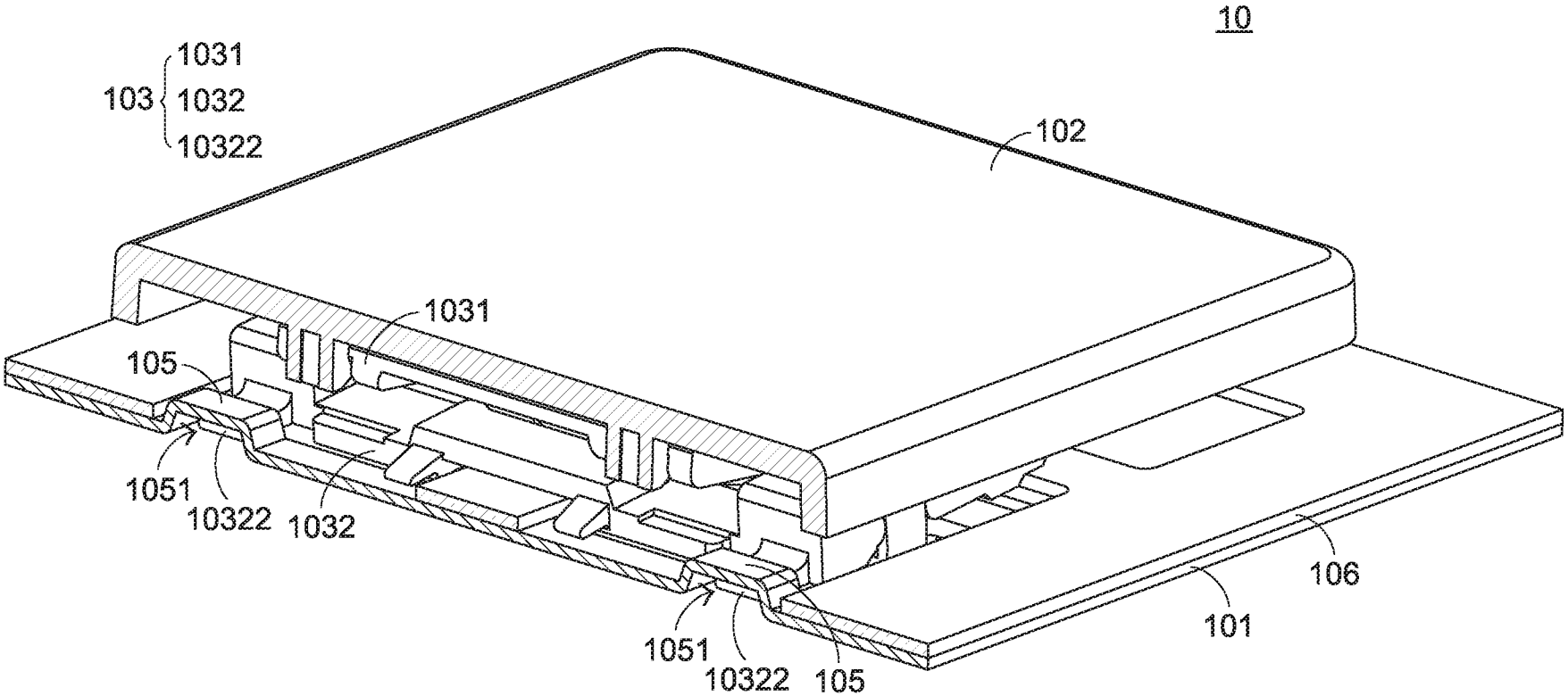
FIG. 5 is a schematic cutaway view illustrating the key structure as shown in FIG. 2 and taken along the line BB.
Figure 6:
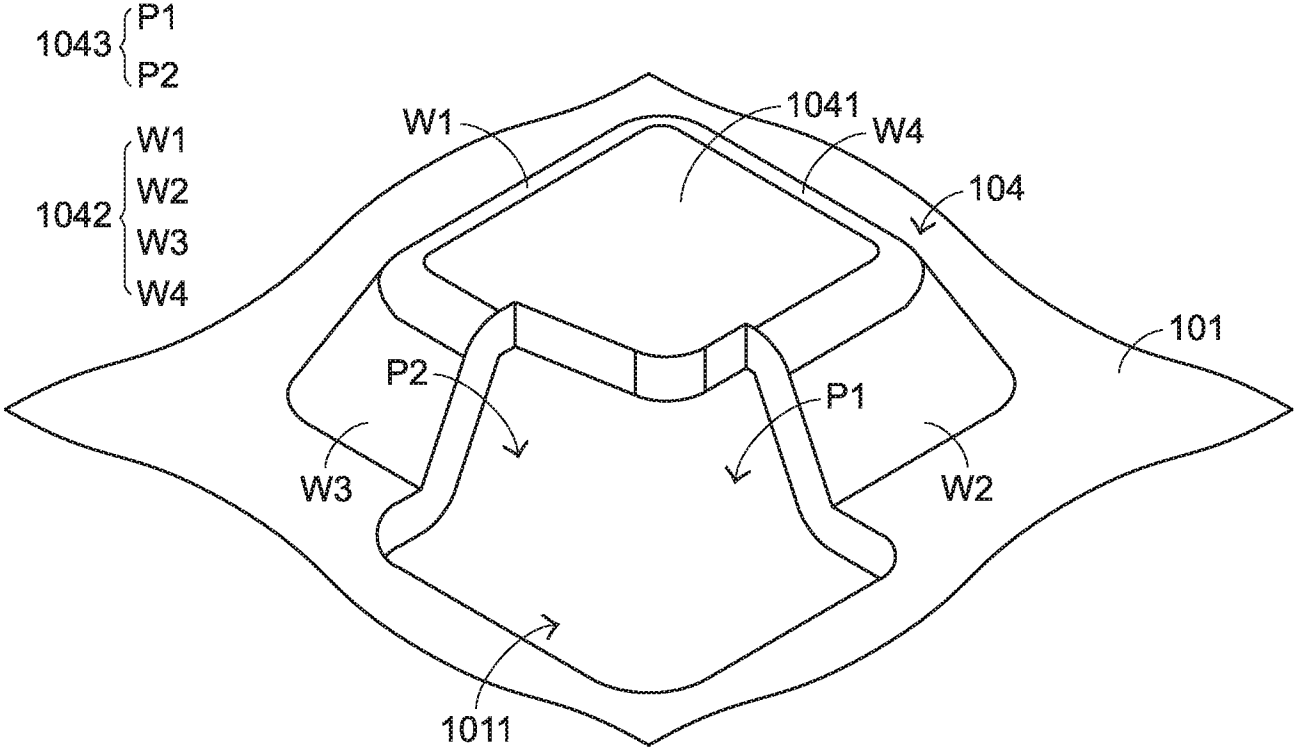
FIG. 6 is a schematic enlarged view illustrating a portion of the key structure as shown in FIG. 3.

Please refer to FIGS. 1, 2, 3, 4, 5 and 6. FIG. 1 is a schematic top view illustrating the outer appearance of a keyboard device according to an embodiment of the present invention. FIG. 2 is a schematic perspective view illustrating a portion of a key structure of the keyboard device as shown in FIG. 1. FIG. 3 is a schematic exploded view illustrating the key structure as shown in FIG. 2. FIG. 4 is a schematic cutaway view illustrating the key structure as shown in FIG. 2 and taken along the line AA. FIG. 5 is a schematic cutaway view illustrating the key structure as shown in FIG. 2 and taken along the line BB. FIG. 6 is a schematic enlarged view illustrating a portion of the key structure as shown in FIG. 3. For succinctness, only a single structure and associated components are shown in FIGS. 2, 3, 4 and 5.

As shown in FIG. 1, the keyboard device 1 comprises plural key structures 10. These key structures 10 are classified into some types, e.g., ordinary keys, numeric keys and function keys. When one of the key structures 10 is depressed by the user's finger, the keyboard device 1 generates a corresponding key signal to a computer, and thus the computer executes a corresponding function. For example, when an ordinary key is depressed, a corresponding English letter or symbol is inputted into the computer. When a numeric key is depressed, a corresponding number is inputted into the computer. In addition, the function keys (F1-F12) can be programmed to provide various quick access functions.

The key structure 10 of the keyboard device 1 will be described in more details as follows.

Please refer to FIGS. 2, 3, 4, 5 and 6 again. The key structure 10 comprises a base plate 101, a keycap 102, a connecting member 103 and at least one raised structure 104. The keycap 102 is located over the base plate 101. The connecting member 103 is arranged between the base plate 101 and the keycap 102. Moreover, the keycap 102 is movable upwardly or downwardly relative to the base plate 101 through the connecting member 103. The connecting member 103 comprises at least one first hook part 10311. The at least one raised structure 104 is installed on the base plate 101. The first hook part 10311 of the connecting member 103 is connected with the corresponding raised structure 104. Consequently, the connecting member 103 is installed on the base plate 101. The raised structure 104 comprises a top wall 1041, a lateral wall 1042 and a perforation 1043. The lateral wall 1042 of the raised structure 104 is connected between the top wall 1041 and the base plate 101. The perforation 1043 is formed in the lateral wall 1042. When the first hook part 10311 of the connecting member 103 is connected with the corresponding raised structure 104, the first hook part 10311 of the connecting member 103 is penetrated through the perforation 1043 of the lateral wall 1042 and contacted with the top wall 1041.

Please refer to FIGS. 3, 4 and 5 again. In this embodiment, the connecting member 103 further comprises a first frame 1031, a second frame 1032 and at least one second hook part 10322. The first frame 1031 and the second frame 1032 of the connecting member 103 are pivotally coupled to each other. The at least one first hook part 10311 of the connecting member 103 is connected with an end of the first frame 1031. The at least one second hook part 10322 of the connecting member 103 is connected with an end of the second frame 1032. In an embodiment, the connecting member 103 is a scissors-type connecting member. It is noted that the example of the connecting member 103 is not restricted. The actions of the connecting member 103 are similar to those of the conventional technologies, and not redundantly described herein.

Please refer to FIGS. 3, 4 and 5 again. In an embodiment, the key structure 10 further comprises at least one coupling structure 105. The at least one coupling structure 105 is installed on the base plate 105. The coupling structure 105 and the at least one raised structure 104 are installed on two opposite sides of the base plate 101, respectively. The at least one second hook part 10322 of the connecting member 103 is connected with the corresponding coupling structure 105. The coupling structure 105 comprises a coupling hole 1051. The second hook part 10322 of the connecting member 103 is penetrated through the coupling hole 1051 of the corresponding coupling structure 105. Consequently, the second hook part 10322 of the connecting member 103 is connected with the corresponding coupling structure 105.

In this embodiment, the at least one first hook part 10311 connected with the first frame 1031 includes two first hook parts 10311, the at least one second hook part 10322 connected with the second frame 1032 includes two second hook parts 10322, the at least one raised structure 104 installed on the first side of the base plate 101 includes two raised structures 104, and the at least one coupling structure 105 installed on second side of the base plate 101 includes two coupling structures 105. It is noted that the numbers of these components or structures are not restricted. When the first frame 1031 of the connecting member 103 is connected with the raised structures 104 through the corresponding first hook parts 10311, each first hook part 10311 is penetrated through the perforation 1043 of the corresponding raised structure 104 and contacted with the top wall 1041. Consequently, the first frame 1031 is installed on the base plate 101. When the second frame 1032 of the connecting member 103 is connected with the corresponding coupling structures 105 through the corresponding second hook parts 10322, each second hook part 10322 is penetrated through the coupling hole 1051 of the corresponding coupling structure 105. Consequently, the second frame 1032 is installed on the base plate 101.

Please refer to FIGS. 2, 3, 4 and 5 again. In an embodiment, the key structure 10 further comprises a membrane circuit board 106. The membrane circuit board 106 is arranged between the base plate 101 and the keycap 102. Moreover, the membrane circuit board 106 comprises at least one first hollow portion 1061 and at least one second hollow portion 1062. In this embodiment, the membrane circuit board 106 comprises two first hollow portions 1061 and two second hollow portions 1062. It is noted that the numbers of the at least one first hollow portion 1061 and the at least one second hollow portion 1062 are not restricted. The raised structures 104 on the first side of the base plate 101 are penetrated through the corresponding first hollow portions 1061 and connected with the corresponding first hook parts 10311 on the first frame 1031. The coupling structures 105 on the second side of the base plate 101 are penetrated through the corresponding second hollow portions 1062 and connected with the corresponding second hook parts 10322 on the second frame 1032.

Please refer to FIGS. 3, 4 and 6 again. In an embodiment, the lateral wall 1042 of the raised structure 104 comprises a first wall part W1, a second wall part W2, a third wall part W3 and a fourth wall part W4. The first wall part W1 and the second wall part W2 of the lateral wall 1042 are opposed to each other. The third wall part W3 and the fourth wall part W4 are opposed to each other. The first wall part W1 and the second wall part W2 are arranged between the third wall part W3 and the fourth wall part W4. The perforation 1043 of each raised structure 104 is arranged between the second wall part W2 and the third wall part W3. That is, a first part P1 of the perforation 1043 is formed after a portion of the second wall part W2 is removed, and a second part P2 of the perforation 1043 is formed after a portion of the third wall part W3 is removed. The first part P1 of the perforation 1043 and the second part P2 of the perforation 1043 are in communication with each other so as to form the perforation 1043 in the lateral wall 1042.

Please refer to FIGS. 3, 4 and 6 again. In an embodiment, the base plate 101 comprises at least one opening 1011. In this embodiment, the at least one opening 1011 includes two openings 1011. It is noted that the number of the at least one opening 1011 is not restricted. The openings 1011 are located at the first side of the base plate 101 wherein the raised structures 104 are installed. These openings 1011 are in communication with the perforations 1043 of the corresponding raised structures 104. Due to the arrangement of the opening 1011 in the base plate 101, the connecting member 103 can be assembled with the raised structures 104 more easily. While the first frame 1031 of the connecting member 103 is connected with the raised structures 104 through the corresponding first hook parts 10311, the first hook parts 10311 on the first frame 1031 are transferred downwardly through the corresponding openings 1011 of the base plate 101, and then the first hook parts 10311 are penetrated upwardly through the perforations 1043 of the corresponding raised structures 104 and contacted with the top walls 1041.

Preferably but not exclusively, the raised structures 104 are integrally formed with the base plate 101. For example, the raised structures 104 are directly formed on the base plate 101 by a stamping process through a mold with a specified shape. Preferably but not exclusively, the coupling structures 105 are integrally formed with the base plate 101. It is noted that numerous modifications may be made while retaining the teachings of the present invention. For example, in another embodiment, the coupling structures 105 and the base plate 101 are individual components.

In the above embodiment, the raised structures 104 are installed on the first side of the base plate 101, and the coupling structures 105 are installed on the second side of the base plate 101. It is noted that numerous modifications may be made while retaining the teachings of the present invention. For example, in another embodiment, the coupling structures 105 are replaced by other raised structures 104. In other words, the raised structures 104 are installed on both of the first side and the second side of the base plate 101.

From the above descriptions, the present invention provides the keyboard device. The key structure of the keyboard device comprises at least one raised structure, which is integrally formed with the base plate. In accordance with a feature of the present invention, the raised structure is a non-open structure with high pull-out resistance. Consequently, after the connecting member is connected with the raised structure and installed on the base plate, the frequent upward/downward movement of the connecting member will not damage and break the raised structure. In this way, the structural strength of the keyboard device is enhanced. Since the raised structure is directly formed on the base plate by a stamping process, the fabricating process is simplified, and the fabricating cost is reduced. In addition, the raised structure formed by the stamping process has a small thickness. Consequently, the outer thickness of the keyboard device is further reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device comprising plural key structures, wherein each of the plural key structures comprises: a base plate; a keycap located over the base plate; a connecting member arranged between the base plate and the keycap, wherein the keycap is movable upwardly or downwardly relative to the base plate through the connecting member, and the connecting member comprises at least one first hook part; and at least one raised structure installed on the base plate, wherein the at least one first hook part of the connecting member is connected with the at least one raised structure, and each of the at least one raised structure comprises a top wall, a lateral wall and a perforation, wherein the lateral wall is connected between the top wall and the base plate, the perforation is formed in the lateral wall, and the at least one first hook part of the connecting member is penetrated through the corresponding perforation and contacted with the corresponding top wall; wherein the lateral wall of each of the at least one raised structure comprises a first wall part, a second wall part, a third wall part and a fourth wall part, wherein the first wall part and the second wall part are opposed to each other, the third wall part and the fourth wall part are opposed to each other, the first wall part and the second wall part are arranged between the third wall part and the fourth wall part, and the perforation is arranged between the second wall part and the third wall part.

2. The keyboard device according to claim 1, wherein the base plate comprises at least one opening, and the at least one opening is in communication with the perforation of the at least one raised structure.

3. The keyboard device according to claim 1, wherein the at least one raised structure is integrally formed with the base plate.

4. The keyboard device according to claim 1, wherein the connecting member further comprises a first frame, a second frame and at least one second hook part, wherein the first frame and the second frame are pivotally coupled to each other, the at least one first hook part is connected with the first frame, and the at least one second hook part is connected with the second frame, wherein the at least one first hook part connected with the first frame is penetrated through the perforation of the at least one raised structure and contacted with the top wall, so that the first frame is installed on the base plate.

5. The keyboard device according to claim 4, wherein each of the plural key structures further comprises at least one coupling structure, and the at least one coupling structure is installed on the base plate, wherein the at least one coupling structure and the at least one raised structure are respectively installed on two opposite sides of the base plate, the at least one second hook part of the connecting member is connected with the at least one coupling structure, and each of the at least one coupling structure comprises a coupling hole, wherein the at least one second hook part connected with the second frame is penetrated through the coupling hole of the at least one coupling structure, so that the second frame is installed on the base plate.

6. The keyboard device according to claim 5, wherein each of the plural key structures further comprises a membrane circuit board, and the membrane circuit board is arranged between the base plate and the keycap, wherein the membrane circuit board comprises at least one first hollow portion and at least one second hollow portion, the at least one raised structure is penetrated through the at least one first hollow portion and connected with the at least one first hook part on the first frame, and the at least one coupling structure is penetrated through the at least one second hollow portion and connected with the at least one second hook part on the second frame.

7. The keyboard device according to claim 5, wherein the at least one coupling structure is integrally formed with the base plate.

8. The keyboard device according to claim 1, wherein the connecting member is a scissors-type connecting member.

9. A key structure, comprising: a base plate; a keycap located over the base plate; a connecting member arranged between the base plate and the keycap, wherein the keycap is movable upwardly or downwardly relative to the base plate through the connecting member, and the connecting member comprises at least one first hook part; and at least one raised structure installed on the base plate, wherein the at least one first hook part of the connecting member is connected with the at least one raised structure, and each of the at least one raised structure comprises a top wall, a lateral wall and a perforation, wherein the lateral wall is connected between the top wall and the base plate, the perforation is formed in the lateral wall, and the at least one first hook part of the connecting member is penetrated through the corresponding perforation and contacted with the corresponding top wall; wherein the lateral wall of each of the at least one raised structure comprises a first wall part, a second wall part, a third wall part and a fourth wall part, wherein the first wall part and the second wall part are opposed to each other, the third wall part and the fourth wall part are opposed to each other, the first wall part and the second wall part are arranged between the third wall part and the fourth wall part, and the perforation is arranged between the second wall part and the third wall part.

* * * * *